US007719509B2

(12) United States Patent
Tanaka

(10) Patent No.: US 7,719,509 B2
(45) Date of Patent: May 18, 2010

(54) DRIVER FOR LIQUID CRYSTAL DISPLAY

(75) Inventor: Yoshiyuki Tanaka, Shiga (JP)

(73) Assignee: NEC Electronics Corporation, Kanagawa (JP)

( * ) Notice: Subject to any disclaimer, the term of this patent is extended or adjusted under 35 U.S.C. 154(b) by 761 days.

(21) Appl. No.: 11/553,893

(22) Filed: Oct. 27, 2006

(65) Prior Publication Data

US 2007/0097059 A1 May 3, 2007

(30) Foreign Application Priority Data

Oct. 28, 2005 (JP) ..... 2005-314210

(51) Int. Cl.
*G09G 3/36* (2006.01)
*G09G 5/10* (2006.01)

(52) U.S. Cl. ..... 345/99; 345/87; 345/98; 345/204; 345/690

(58) Field of Classification Search ..... 345/55, 345/76, 77, 84, 87, 88, 98, 99, 100, 204, 345/690; 315/160, 167, 169.1, 169.2
See application file for complete search history.

(56) References Cited

U.S. PATENT DOCUMENTS 6,809,706 B2 * 10/2004 Shimoda ..... 345/55
2003/0132906 A1 * 7/2003 Tanaka et al. ..... 345/89
2006/0232539 A1 * 10/2006 Hashimoto ..... 345/96

FOREIGN PATENT DOCUMENTS

JP 2003-330429 A 11/2003

* cited by examiner

*Primary Examiner*—My-Chau T Tran
(74) *Attorney, Agent, or Firm*—Sughrue Mion, PLLC

(57) ABSTRACT

In a liquid crystal display driving circuit, upon time-sharing output of gray scale voltages from an amplifier of an output circuit for each unit pixel composed of three sub-pixels of red (R), green (G) and blue (B) in the output sequence of R, G and B, a data matching detector compares gray scale data corresponding to R, G and B sub-pixels for each unit pixel and, it they match in all pixels of each scan line, a driving time of the amplifier is set such that G output interval and B output interval are shorter than R output interval at the top by an output control signal AS output from a control signal generator.

8 Claims, 11 Drawing Sheets

DETECTION OF MATCHING OF
TWO TONE DATA R, G DATA OUTPUT IN SUCCESSION IN UNIT PIXEL

RELATED ART

RELATED ART

RELATED ART

DRIVER FOR LIQUID CRYSTAL DISPLAY

BACKGROUND OF THE INVENTION

1. Field of the Invention

The present invention relates to a driver for liquid crystal display and particularly to a driver for driving a liquid crystal panel used as a display of portable computers, PDA (Personal Digital Assistants), or portable electronic equipment such as mobile phones and PHS (Personal Handy-phone System).

2. Description of Related Art

As a driver for liquid crystal display used in portable electronic equipment, a liquid crystal display driver which outputs gray scale voltages in time-sharing manner from a unit amplifier for at least each unit pixel of a liquid crystal panel is used. FIG. 7 is a block diagram showing an exemplary configuration of drivers of such a liquid crystal panel 100. In this example, the resolution of the liquid crystal panel 100 is 176×220 pixels. One pixel is composed of three sub-pixels of Red (R), Green (G) and Blue (B), and accordingly there total 528×220 sub-pixels. The time-sharing output of this example divides outputs into three (R, G, and B) portions. The liquid crystal panel 100 includes a total 176 sets of R data lines 101*a*, G data lines 101*b* and B data lines 101*c* which are arranged crosswise and each extends lengthwise on FIG. 7, and 220 lines of scan lines 102 which are arranged lengthwise and each extends crosswise on FIG. 7, though only one of them is illustrated in FIG. 7. Each sub-pixel is composed of a TFT 103, a pixel capacitor 104, and a liquid crystal element 105. The gate terminal of the TFT 103 is connected to the scan line 102, and the source (drain) terminal of the TFT 103 is connected to data lines 101*a*, 101*b* or 101*c*. The drain (source) terminal of the TFT 103 is connected to the pixel capacitor 104 and the liquid crystal element 105. The terminals 106 of the pixel capacitor 104 and the liquid crystal element 105 which are not connected to the TFT 103 may be connected to a common electrode, though not shown. The input terminals of the 176 sets of data lines 101*a*, 101*b* and 101*c* are respectively connected to the output terminals a, b and c of change-over switches $\mathbf{107}_1$ to $\mathbf{107}_{176}$ with 1 input and 3 outputs.

A driving circuit of the liquid crystal panel 100 is composed, schematically, of a controller 200, a data driver 300, and a scan driver 400. The driving circuit is normally in the form of an integrated circuit (IC). In portable electronic equipment, the controller 200 and the data driver 300, or the controller 200, the data driver 300, and the scan driver 400, for example, may be integrated into one IC chip.

The controller 200 converts digital image data which is supplied from outside to digital gray scale data which can be processable by the data driver 300 and also controls the timings of the data driver 300, the scan driver 400, and the change-over switches $\mathbf{107}_1$ to $\mathbf{107}_{176}$ of the liquid crystal panel 100.

The data driver 300 converts the gray scale data of one scan line 102 which is supplied from the controller 200 into an analog gray scale voltage for each of the scan lines 102 (i.e. in each horizontal period) and applies the analog gray scale voltage to the data lines 101*a*, 101*b* and 101*c* in time-sharing manner.

The scan driver 400 sequentially drives the scan lines 102 in each horizontal period to turn ON the TFTs which are connected to each scan line 102, thereby supplying the gray scale voltage which is applied to the data lines 101*a*, 101*b* and 101*c* to the liquid crystal elements 105.

The controller 200 includes a data processor 210 and a control signal generator 220 as shown in FIG. 8.

The data processor 210 retrieves image data supplied from outside, e.g. Red data (Rdata), Green data (Gdata) and Blue data (Bdata) of 6 bit each, at the timing of a dot clock Dclk also supplied from outside. Then, it converts the Rdata, Gdata and Bdata into Red data (RD), Green data (GD) and Blue data (BD) of 6 bit each, which are gray scale data that can be driven by the data driver 300.

The control signal generator 220 generates a signal for controlling the timings of the data driver 300, the scan driver 400, and the change-over switches $\mathbf{107}_1$ to $\mathbf{107}_{176}$ of the liquid crystal panel 100 based on a dot clock Dclk, a horizontal synchronizing signal Hsync and a vertical synchronizing signal Vsync which are supplied from outside. The control signal generator 220 also generates a strobe signal STB, a clock HCK, a horizontal start pulse HST, switch control signals RS1, GS1 and BS1, and an output control signal AS for the data driver 300. The control signal generator 220 further generates a clock VCK and a vertical start pulse VST for the scan driver 400. The control signal generator 220 generates switch control signals RS2, GS2 and BS2 for the change-over switches $\mathbf{107}_1$ to $\mathbf{107}_{176}$ of the liquid crystal panel 100.

The data driver 300 is described hereinafter. As shown in FIG. 9, the data driver 300 includes a shift register 310, a data register 320, a data latch circuit 330, a switching circuit 340, a D/A converter 350, and an output circuit 360.

The shift register 310 performs shift operation for shifting the horizontal start pulse HST supplied from the controller 200 and outputs total 176 bits of parallel sampling pulses $SP_1$ to $SP_{176}$ in synchronization with the clock HCK also supplied from the controller 200.

The data register 320 retrieves the each 6-bit gray scale data RD, GD and BD supplied from the controller 200 as gray scale data $RD_1$, $GD_1$ and $BD_1$ to $RD_{176}$, $GD_{176}$ and $BD_{176}$ in synchronization with the sampling pulses $SP_1$ to $SP_{176}$ supplied from the shift register 310, and supplies them to the data latch circuit 330.

The data latch circuit 330 latches the gray scale data $RD_1$, $GD_1$ and $BD_1$ to $RD_{176}$, $GD_{176}$ and $BD_{176}$ supplied from the data register 320 in synchronization with the rising edge of the strove signal STB supplied from the controller 200. The data latch circuit 330 then retains the latched gray scale data $RD_1$, $GD_1$ and $BD_1$ to $RD_{176}$, $GD_{176}$ and $BD_{176}$ until the strobe signal STB is supplied next, which is, for one horizontal period.

The switching circuit 340 includes 176 sets of change-over switches $\mathbf{341}_1$ to $\mathbf{341}_{176}$ with 3 inputs and 1 output. In synchronization with the switch control signals RS1, GS1 and BS1 supplied from the controller 200, the switching circuit 340 supplies the gray scale data $RD_1$, $GD_1$ and $BD_1$ to $RD_{176}$, $GD_{176}$ and $BD_{176}$ supplied from the data latch circuit 330 in time-sharing manner in the order of ($RD_1$ to $RD_{176}$)→($GD_1$ to $GD_{176}$)→($BD_1$ to $BD_{176}$) to the D/A converter 350.

Based on the values of the 6-bit gray scale data $RD_1$, $GD_1$ and $BD_1$ to $RD_{176}$, $GD_{176}$ and $BD_{176}$ which are time-sharingly supplied from the switching circuit 340, the D/A converter 350 time-sharingly selects one gray scale voltage from 64 analog gray scale voltages V1 to V64, and supplies gray scale voltages $RV_1$, $GV_1$ and $BV_1$ to $RV_{176}$, $GV_{176}$ and $BV_{176}$ in time-sharing manner in the order of ($RV_1$ to $RV_{176}$)→($GV_1$ to $GV_{176}$)→($BV_1$ to $BV_{176}$) to the output circuit 360.

The output circuit 360 includes amplifiers $\mathbf{361}_1$ to $\mathbf{361}_{176}$, switches $\mathbf{362}_1$ to $\mathbf{362}_{176}$ which are respectively placed in the subsequent stages of the amplifiers $\mathbf{361}_1$ to $\mathbf{361}_{176}$, and switches $\mathbf{363}_1$ to $\mathbf{363}_{176}$ which are connected in parallel between the input ends of the amplifiers $\mathbf{361}_1$ to $\mathbf{361}_{176}$, and the corresponding output ends of the switches $\mathbf{362}_1$ to $\mathbf{362}_{176}$ as shown in FIG. 10. The output circuit 360 amplifies the gray scale voltages $RV_1$, $GV_1$ and $BV_1$ to $RV_{176}$, $GV_{176}$ and $BV_{176}$ which are supplied from the D/A converter 350 in time-sharing manner in the order of ($RV_1$ to $RV_{176}$)→($GV_1$ to $GV_{176}$)→($BV_1$ to $BV_{176}$) and supplies them to the output terminals S1 to S176 through the switches $\mathbf{362}_1$ to $\mathbf{362}_{176}$ which are turned ON by the output control signal AS supplied from the controller 200.

Alternatively, the output circuit 360 may supply the gray scale voltages $RV_1$, $GV_1$ and $BV_1$ to $RV_{176}$, $GV_{176}$ and $BV_{176}$ which are supplied from the D/A converter 350 to the output terminals S1 to S176 through the switches $\mathbf{363}_1$ to $\mathbf{363}_{176}$ which are turned ON by the output control signal AS supplied from the controller 200 through inverters $INV_1$ to $INV_{176}$. The switches $\mathbf{362}_1$ to $\mathbf{362}_{176}$ are turned ON when the output control signal AS is "H" level, and the switches $\mathbf{363}_1$ to $\mathbf{363}_{176}$ are turned OFF when the output control signal AS is "L" level. The output control signal AS is supplied also to the amplifiers $\mathbf{361}_1$ to $\mathbf{361}_{176}$, so that the amplifiers $\mathbf{361}_1$ to $\mathbf{361}_{176}$ are in operating state only when the output control signal AS is "H" level. When the output control signal AS is "L" level, the amplifiers $\mathbf{361}_1$ to $\mathbf{361}_{176}$ are non-operating state to thereby reduce power consumption.

Such an output circuit is disclosed in Japanese Unexamined Patent Application Publication No. 2003-330429, for example.

The operation of the controller 200 and the data driver 300 in the liquid crystal display driving circuit having the above configuration is described hereinafter. First, the operation up to latching of gray scale data by the data latch circuit 330 of the data driver 300 shown in FIG. 9 is described hereinafter without any reference to a timing chart. The control signal generator 220 of the controller 200 shown in FIG. 8 supplies to the data driver 300 a clock HCK, a strobe signal STB, and a horizontal start pulse HST which delays from the strobe signal STB by the length of a pulse of the clock HCK. In the data driver 300 shown in FIG. 9, the shift register 310 thereby performs shift operation for shifting the horizontal start pulse HST in synchronization with the clock HCK and outputs 176 bits of parallel sampling pulses SP1 to SP176. At substantially the same time, the data processor 210 of the controller 200 shown in FIG. 8 converts Red data (Rdata), Green data (Gdata) and Blue data (Bdata) of 6 bit each, which are image data supplied from outside, into gray scale data RD, GD and BD of 6 bit each and supplies them to the data driver 300. As a result, in the data driver 300 shown in FIG. 9, the gray scale data RD, GD and BD are sequentially latched by the data register 320 as gray scale data $RD_1$, $GD_1$ and $BD_1$ to $RD_{176}$, $GD_{176}$ and $BD_{176}$ in synchronization with the sampling pulses SP1 to SP176 supplied from the shift register 310, and then latched by the data latch circuit 330 at a time in synchronization with the rising edge of the strobe signal STB and retained therein for one horizontal period.

The operation in the data driver 300 shown in FIG. 9 from output of the gray scale data from the data latch circuit 330 to supply of the gray scale voltage from the output circuit 360 to each data line is described hereinafter with reference to the timing chart of FIG. 11. At the timing as shown in FIG. 11, the control signal generator 220 of the controller 200 shown in FIG. 8 supplies the switch control signals RS1, GS1 and BS1 and the output control signal AS to the data driver 300, and supplies the switch control signals RS2, GS2 and BS2 to the change-over switches $\mathbf{107}_1$ to $\mathbf{107}_{176}$ of the liquid crystal panel 100. The switch control signals RS1, GS1 and BS1 respectively have pulse widths which correspond to t10 to t20, t20 to t30 and t30 to t40 which are equally divided (time-shared) portions of time t10 to t40 in one horizontal period. The switch control signals RS2, GS2 and BS2 respectively rise at times t11, t21 and t31 which delay from the rising edges of the switch control signals RS1, GS1 and BS1 by the length of a pulse of the clock HCK and fall at times t13, t23 and t33 which precede the falling edges of the switch control signals RS1, GS1 and BS1 by the length of a pulse of the clock HCK. The output control signal AS rises at times t10, t20 and t30 and falls at times t12, t22 and t32 which are respectively during t11 to t13, t21 to t23 and t31 to t33. The length of "H" level of the output control signal AS at times t10 to t12, t20 to t22 and t30 to t32, which is the operating time of each time-sharing output period of the amplifiers $\mathbf{361}_1$ to $\mathbf{361}_{176}$ is set to the same predetermined time period determined in consideration of a maximum change in gray scale voltage output before and after the shift of the time-sharing output.

At time t10 when the switch control signal RS1 rises to "H" level, the input terminal a is connected to the output terminal in each of the change-over switches $\mathbf{341}_1$ to $\mathbf{341}_{176}$ of the switching circuit 340. As a result, the gray scale data $RD_1$ to $RD_{176}$ which are latched by the data latch circuit 330 are supplied to the D/A converter 350 through the switching circuit 340, then converted into analog gray scale voltages $RV_1$ to $RV_{176}$ in the D/A converter 350, and supplied to the output circuit 360. The gray scale voltages $RV_1$ to $RV_{176}$ supplied to the output circuit 360 are amplified by the amplifiers $\mathbf{361}_1$ to $\mathbf{361}_{176}$ and supplied to the output terminals S1 to S176 through the switches $\mathbf{362}_1$ to $\mathbf{362}_{176}$ which are turned ON by the output control signal AS which rises to "H" level at the same time as the switch control signal RS1.

At t11 when the switch control signal RS2 rises to "H" level, the input terminal is connected to the output terminal a in the change-over switches $\mathbf{107}_1$ to $\mathbf{107}_{176}$ of the liquid crystal panel 100. As a result, the gray scale voltages $RV_1$ to $RV_{176}$ from the output terminals S1 to S176 are supplied to the 176 data lines 101*a* through the change-over switches $\mathbf{107}_1$ to $\mathbf{107}_{176}$.

At t12, the voltages of the output terminals S1 to S176 reach target values of the gray scale voltages $RV_1$ to $RV_{176}$ by the operation of the amplifiers $\mathbf{361}_1$ to $\mathbf{361}_{176}$ at time t10 to t12. At t12 when the output control signal AS falls to "L" level, the gray scale voltages $RV_1$ to $RV_{176}$ supplied to the output circuit 360 are supplied to the output terminals S1 to S176 through the ON switches $\mathbf{363}_1$ to $\mathbf{363}_{176}$. The amplifiers $\mathbf{361}_1$ to $\mathbf{361}_{176}$ enter the non-operating state to reduce power consumption. Though the amplifiers $\mathbf{361}_1$ to $\mathbf{361}_{176}$ stay in the non-operating state during t12 to t20, the gray scale voltages $RV_1$ to $RV_{176}$ are supplied to the output terminals S1 to S176 through the switches $\mathbf{363}_1$ to $\mathbf{363}_{176}$, and therefore the voltages of the output terminals S1 to S176 remain to be the target values of the gray scale voltages $RV_1$ to $RV_{176}$.

At t13 when the switch control signal RS2 falls to "L" level, the input terminal is disconnected from the output terminal a in the change-over switches $\mathbf{107}_1$ to $\mathbf{107}_{176}$ of the liquid crystal panel 100. As a result, the gray scale voltages $RV_1$ to $RV_{176}$ from the output terminals S1 to S176 are no longer supplied to the 176 data lines 101*a*.

At t20 when the switch control signal RS1 falls to "L" level, the input terminal a is disconnected from the output terminal in the change-over switches $\mathbf{341}_1$ to $\mathbf{341}_{176}$ of the switching circuit 340. Then, at t20 to t30, the gray scale voltages $GV_1$ to $GV_{176}$ from the output terminals S1 to S176 are supplied to the 176 data lines 101*b* by the switch control signal GS1, the output control signal AS and the switch control signal GS2 in the same manner as the operation at time t10 to t20 described above.

Further, at t30 to t40, the gray scale voltages $BV_1$ to $BV_{176}$ from the output terminals S1 to S176 are supplied to the 176 data lines 101*c* by the switch control signal BS1, the output control signal AS and the switch control signal BS2 in the same manner as the operation at time t10 to t20 described above.

The liquid crystal display driving circuit described above enables control of one pixel of the liquid crystal panel, including three sub-pixels of red (R), green (G) and blue (B), with 1 output by way of outputting gray scale voltages in time sharing manner within one horizontal period.

Regarding such a liquid crystal display driving circuit as described above, there is a demand for further reduction in power consumption. In the above liquid crystal display driving circuit, the operating time for each time-sharing output of the amplifiers $361_1$ to $361_{176}$ shown in FIG. 10 is set to the same predetermined time period which is determined in consideration of a maximum change in gray scale voltage output before and after the shift of the time-sharing output. If a change in gray scale voltage output before and after the shift of the time-sharing output is small, the voltage of the output terminal by the latter output reaches a target value of the gray scale voltage soon. At this time, the amplifiers $361_1$ to $361_{176}$ stay in the operating state until reaching the above predetermined time even after the voltage of the output terminal by the latter output reaches a target value, which causes wasteful power consumption.

SUMMARY OF THE INVENTION

According to an aspect of the present invention, there is provided a driving circuit for liquid crystal display comprising a unit amplifier for time-sharingly outputting a gray scale voltage which is D/A converted from gray scale data corresponding to each sub-pixel at least for each unit pixel to a data line of a liquid crystal panel having a plurality of unit pixels respectively composed of three sub-pixels of red, green and blue for each scan line, the sub-pixels driven through the data line sequentially for each scan line, wherein the gray scale data is compared for each unit pixel, and an operating time of the unit amplifier is controlled based on a comparison result.

According to the present invention, if gray scale data corresponding to at least two gray scale voltages which are output in succession by time-sharing manner match in all unit pixels of each scan line, a driving time period of an amplifier of an output circuit of a data driver can be controlled such that a latter output interval is shorter than an interval at the beginning of the output sequence, thereby reducing power consumption.

BRIEF DESCRIPTION OF THE DRAWINGS

The above and other objects, advantages and features of the present invention will be more apparent from the following description taken in conjunction with the accompanying drawings, in which.

DESCRIPTION OF THE PREFERRED EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purposed.

Figure 1:
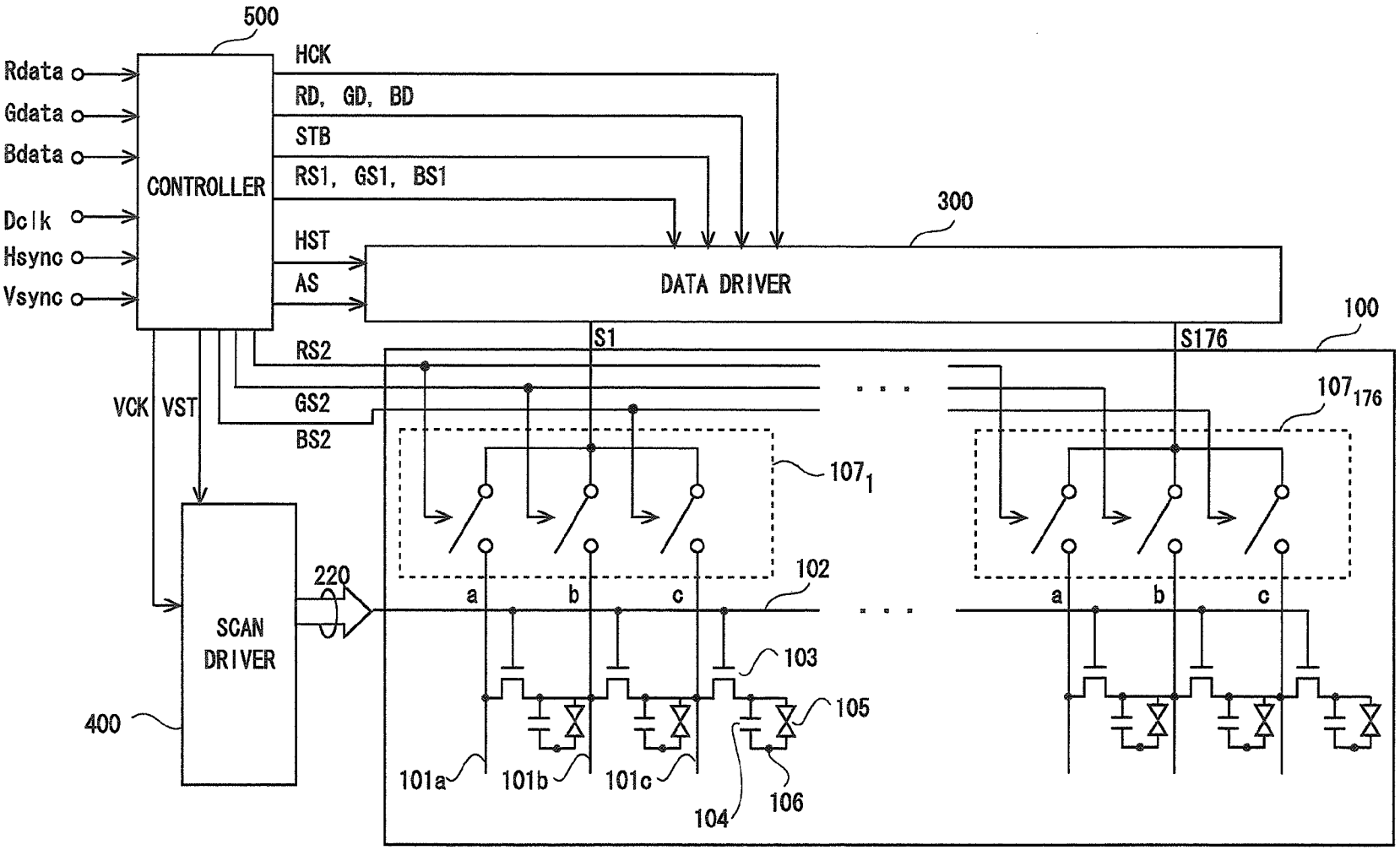
FIG. 1 is a block diagram of a driving circuit for liquid crystal display according to an embodiment of the present invention.
Figure 2:
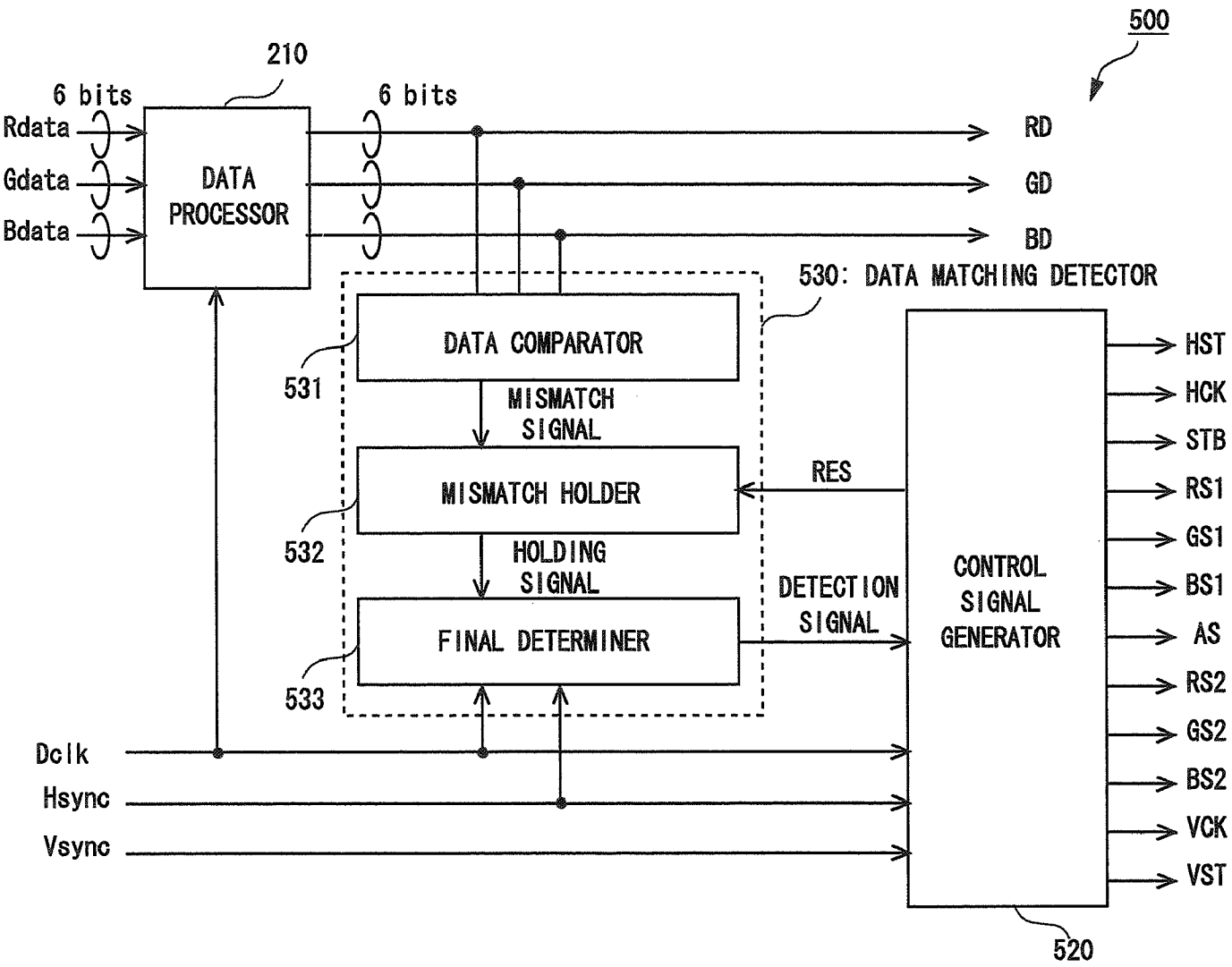
FIG. 2 is a block diagram showing the configuration of a controller used in the driving circuit for liquid crystal display shown in FIG. 1.
Figure 7:
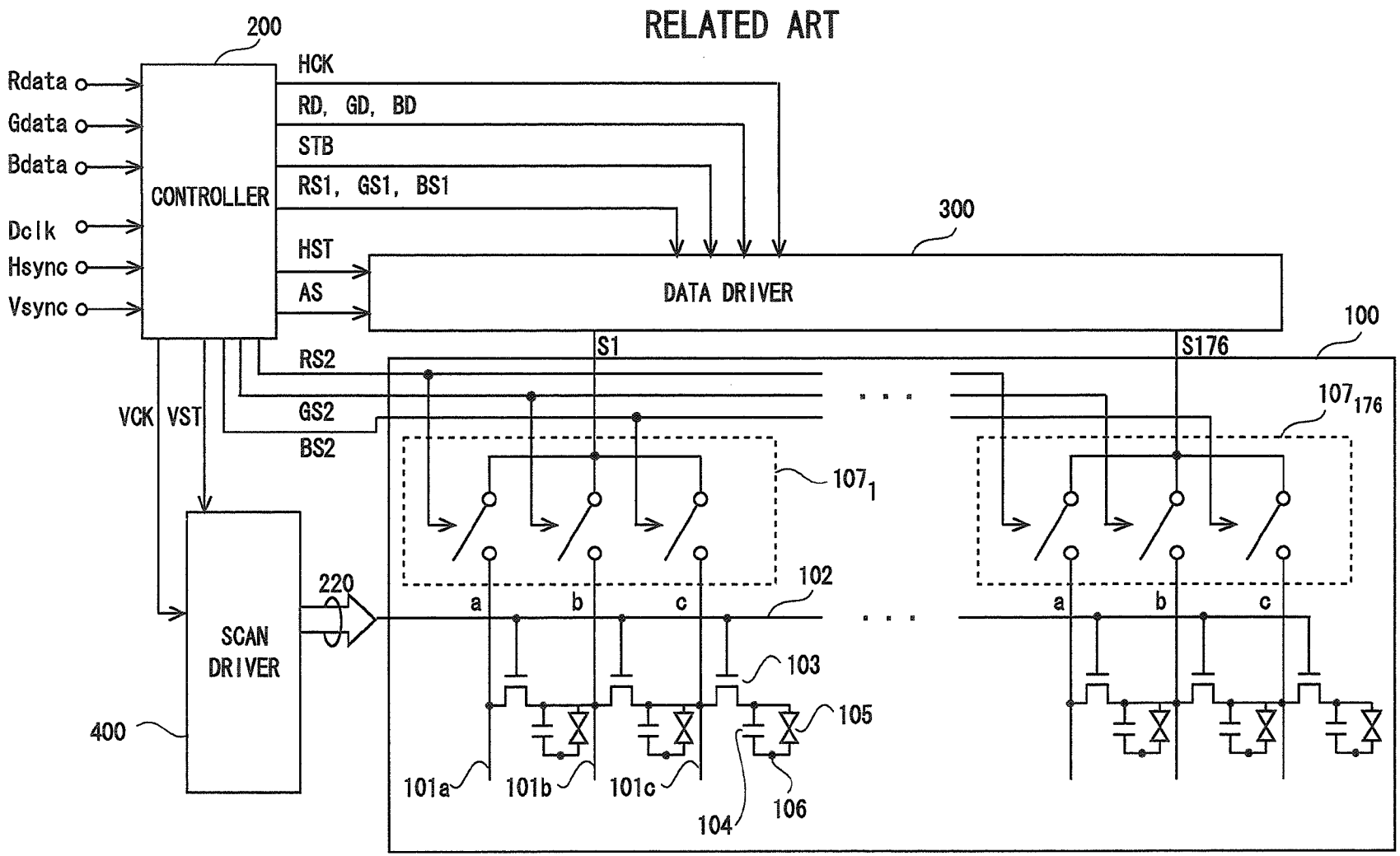
FIG. 7 is a block diagram of a driving circuit for liquid crystal display according to a related art.
Figure 8:
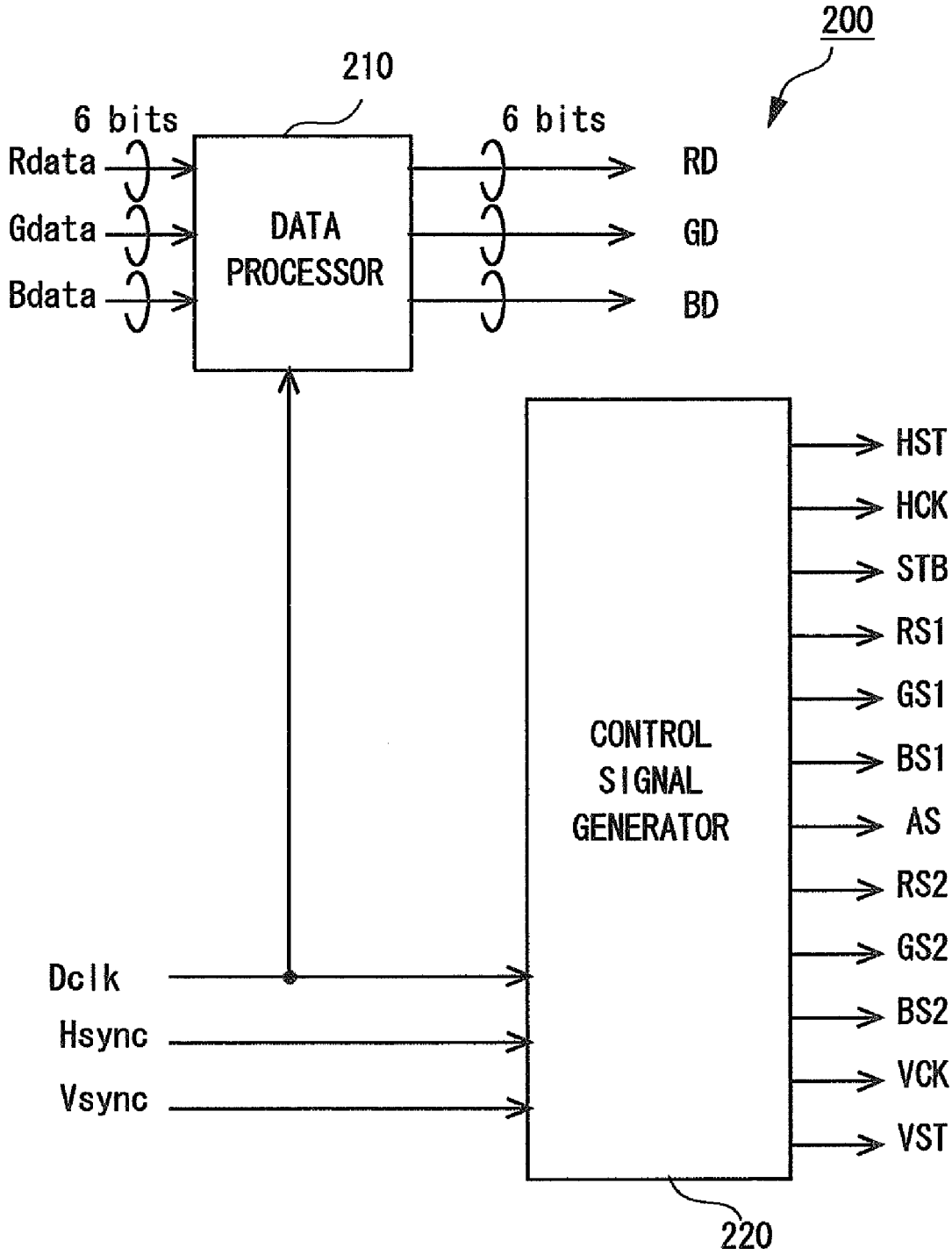
FIG. 8 is a block diagram showing the configuration of a controller used in the driving circuit for liquid crystal display shown in FIG. 7.

An exemplary embodiment of the present invention is described hereinafter with reference to the drawings. FIG. 1 illustrates one embodiment of the present invention, and the same elements as in FIG. 7 are denoted by the same reference numerals or symbols and redundant description is not provided herein. This embodiment uses a controller 500 in place of the controller 200 of FIG. 7. The components other than the controller 500 are the same as those in FIG. 7. This embodiment is applicable to a driving circuit of a line inversion driving scheme and a frame inversion driving scheme but not applicable to a driving circuit of a dot inversion driving scheme. FIG. 2 is a block diagram showing the configuration of the controller 500. The same elements as in FIG. 8 are denoted by the same reference numerals or symbols and redundant description is not provided herein. The controller 500 has the same data processor 210 as in FIG. 7 and further has a data matching detector 530. The controller 500 uses a control signal generator 520 in place of the control signal generator 220 shown in FIG. 8.

The data matching detector 530 includes a data comparator 531, a mismatch holder 532, and a final determiner 533. The data comparator 531 compares the gray scale data RD, GD and BD of one scan line 102 which are supplied from the data processor 210 for each horizontal period and outputs a mismatch signal indicating the result of mismatch/match which is generated per pixel. The mismatch holder 532 is set or reset in accordance with a mismatch signal from the data comparator 531 and a reset signal RES from the control signal generator 520, holds the mismatch signal generated per pixel until the reset signal RES is input and then outputs the signal as a holding signal. The holding signal is "L" level while the gray scale data RD, GD and BD all match each other; however, once the gray scale data RD, GD and BD become mismatch, the holding signal stays "H level" until the reset signal RES is input. The final determiner 533 receives the holding signal from the mismatch holder 532 and reads the level of the holding signal in synchronization with the rising edge of the dot clock Dclk after the input of the horizontal synchronizing signal Hsync in the next horizontal period and outputs as a detection signal.

The control signal generator 520 of this embodiment is different from the control signal generator 220 of FIG. 8 in that the timings of the switch control signals RS1, GS1 and BS1 and the output control signal AS are controlled based on a detection signal and that a reset signal RES is output.

The operation of the controller 500 is described hereinafter with reference to FIGS. 3 and 4. The controller 500 generates the strobe signal STB, clock HCK, horizontal start pulse HST, vertical start pulse VST, and switch control signals RS2, GS2 and BS2 in the same manner as the controller 200 shown in FIG. 8, and the relevant description is not provided herein.

The operation of the data matching detector 530 is described hereinafter with reference to FIG. 3. In each horizontal period, the reset signal RES which delays from the horizontal synchronizing signal Hsync by the length of a pulse of the dot clock Dclk is supplied from the control signal generator 520 to the mismatch holder 532 to thereby initialize the mismatch holder 532. After the mismatch holder 532 is initialized in each horizontal period, the image data Rdata, Gdata and Bdata of one scan line 102 supplied from outside are input to the data processor 210 in synchronization with the rising edge of the dot clock Dclk and then output from the data processor 210 as gray scale data RD, GD and BD. The gray scale data RD, GD and BD are supplied from the data processor 210 to the data comparator 531 in each horizontal period, so that the data comparator 531 compares the gray scale data RD, GD and BD in each unit pixel in synchronization with the falling edge of the clock Dclk. The comparison result is supplied as a mismatch signal to the mismatch holder 532.

Figure 3:
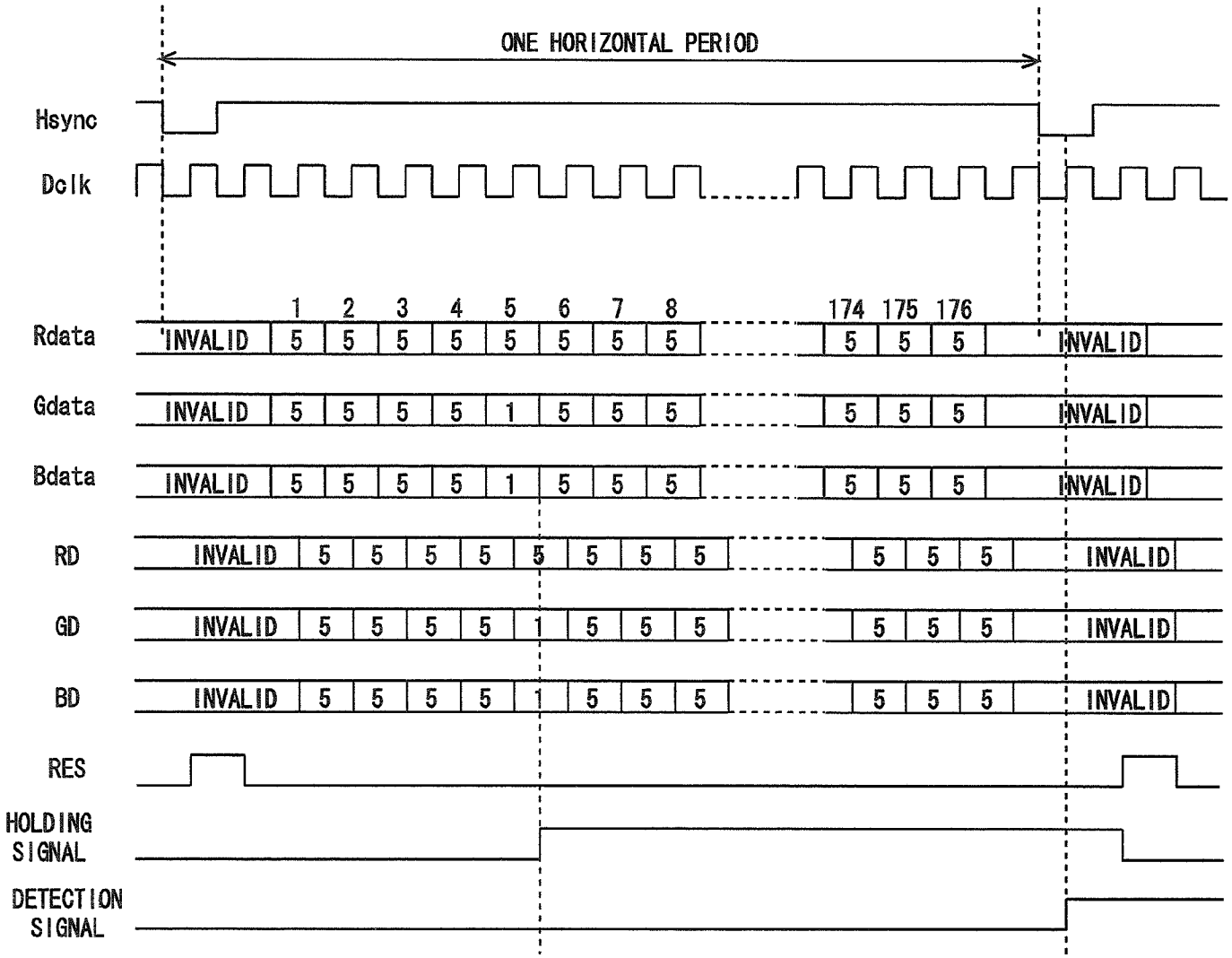
FIG. 3 is a view to describe the operation of a data matching detector used in the controller shown in FIG. 2.

In the example shown in FIG. 3, the gray scale data RD, GD and BD from the first to fourth unit pixels match each other with the value "5" (expressed by the system of decimal numeration for convenience), and a mismatch signal of "L" level is supplied from the data comparator 531 to the mismatch holder 532 per unit pixel. The "L" level is thereby held by the mismatch holder 532, and the mismatch holder 532 outputs a holding signal of "L" level. On the other hand, the gray scale data RD, GD and BD in the fifth unit pixel do not match with the values "5, 1, 1", and a mismatch signal of "H" level is supplied from the data comparator 531 to the mismatch holder 532. The "H" level is thereby held by the mismatch holder 532, and the mismatch holder 532 outputs a holding signal of "H" level. Once the "H" level mismatch signal is supplied to the mismatch holder 532 as a result of comparison of the gray scale data RD, GD and BD in the fifth unit pixel, the mismatch holder 532 outputs a holding signal of "H" level after that, regardless of the match or mismatch of the gray scale data RD, GD and BD in the sixth and subsequent unit pixels, until the reset signal RES is input. Then, the holding signal of "H" level is input to the final determiner 533 in synchronization with the rising edge of the dot clock Dclk after the input of the horizontal synchronizing signal Hsync in the next horizontal period, and the final determiner 533 outputs the signal as a detection signal to the control signal generator 520.

Figure 4A:
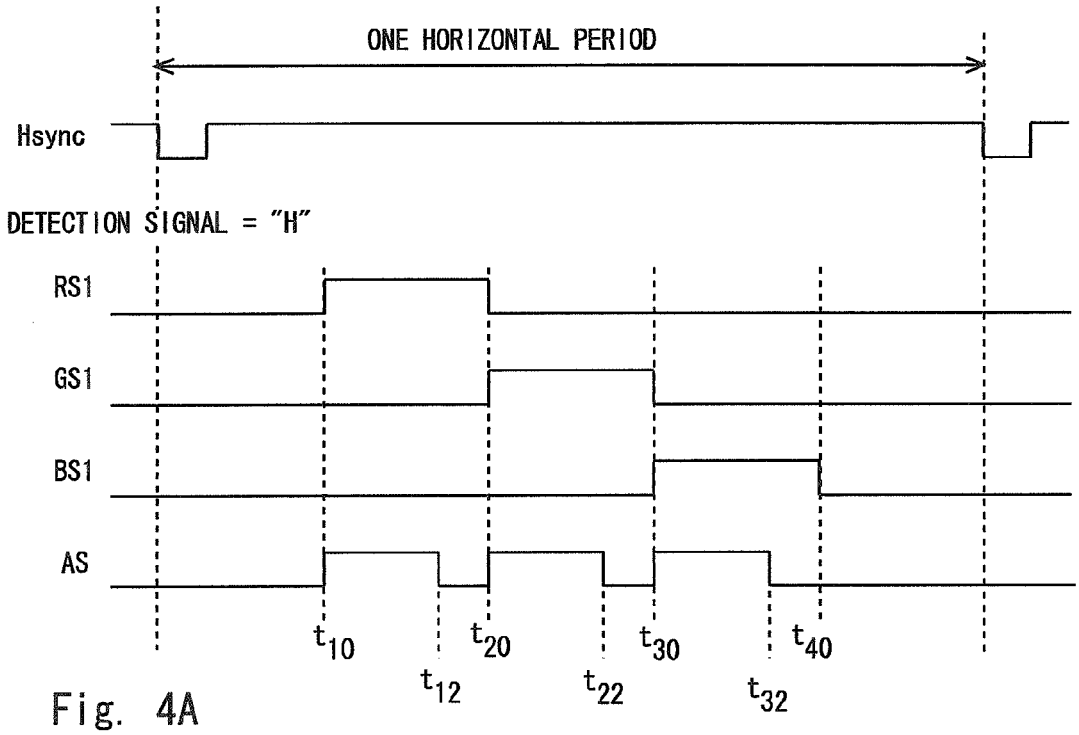
FIG. 4A is a view to describe the operation of a control signal generator used in the controller shown in FIG. 2.
Figure 4B:
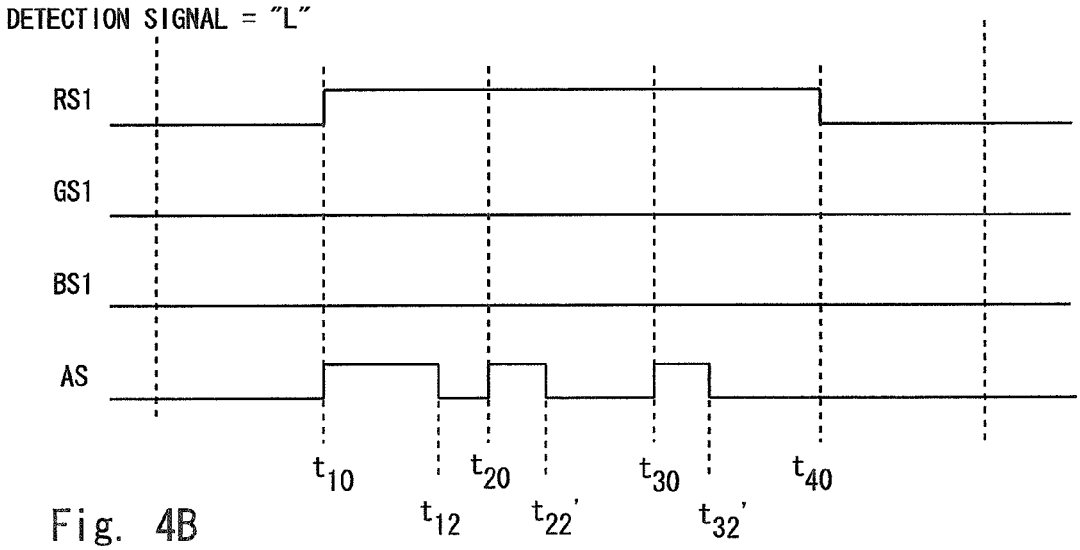
FIG. 4B is a view to describe the operation of a control signal generator used in the controller shown in FIG. 2.

Referring then to FIGS. 4A and 4B, the operation that the control signal generator 520 controls the timings of the switch control signals RS1, GS1 and BS1 and the output control signal AS based on a detection signal is described hereinafter.

Figure 11:
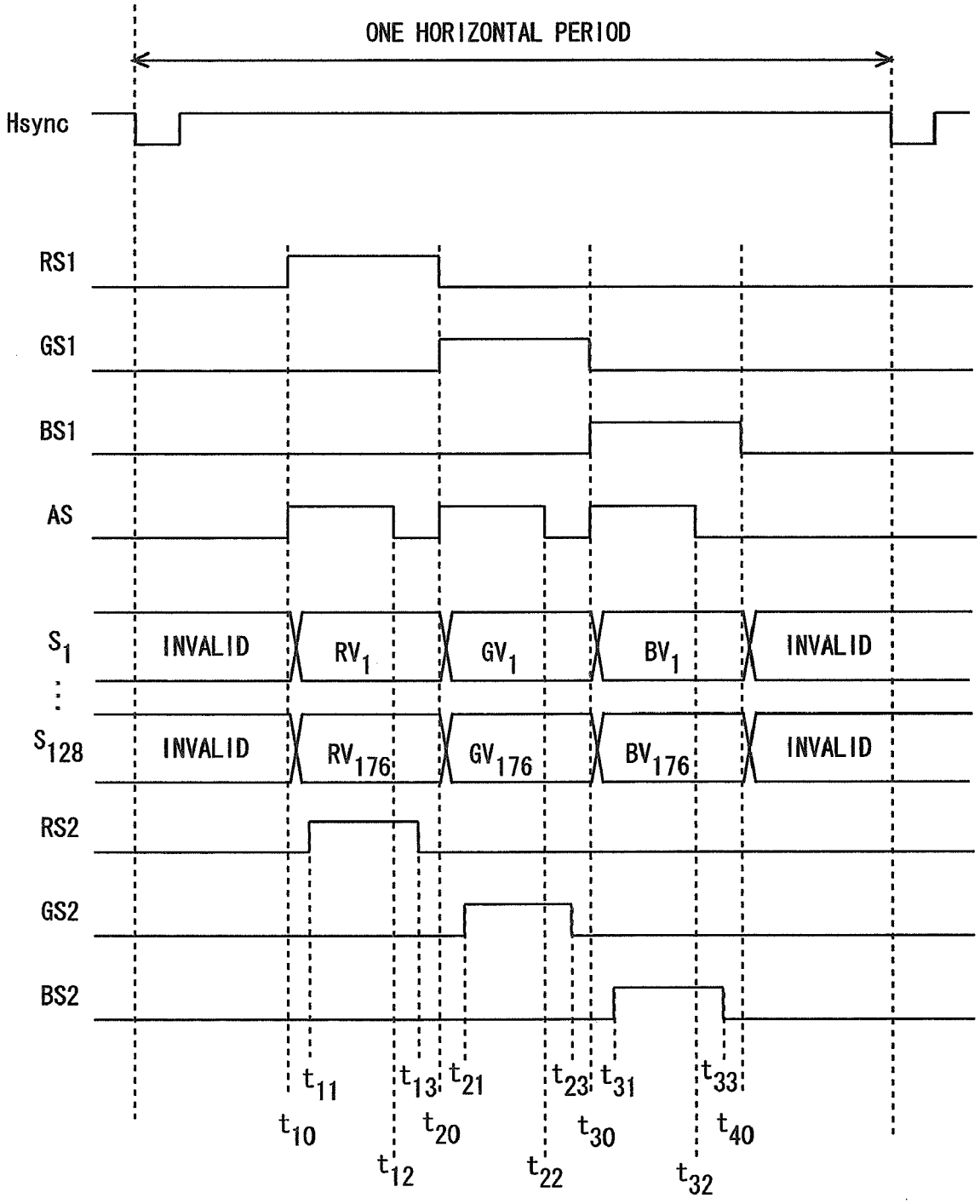
FIG. 11 is a view to describe the operation of the driving circuit for liquid crystal display shown in FIG. 8.

(a) When a detection signal is "H" level indicating data mismatch, the signals of the same timing as the switch control signals RS1, GS1 and BS1 and the output control signal AS from the control signal generator 220 of a conventional liquid crystal display driving circuit shown in FIG. 11 are generated as shown in FIG. 4A.

(b) When a detection signal is "L" level indicating data match, the switch control signals RS1, GS1 and BS1 are generated so that only the switch control signal RS1 is at "H" level and the switch control signals GS1 and BS1 stay "L" level during the period of time t10 to t40. The output control signal AS rises and falls in the same timings as in the case (a) during time t10 to t20. During time t20 to t40, the pulse widths of the output control signal AS at time t20 to t22' and time t30 to t32' are generated to be shorter than the corresponding pulse widths in the case (a), so that the amplifier is turned on for a short time period within the range to complement the reduction in output voltage due to panel capacitance at the switching of the R, G and B data lines 101*a*, 101*b* and 101*c* by the change-over switch 107 of the liquid crystal panel 100. The pulse widths of the output control signal AS at time t20 to t22' and time t30 to t32' may be therefore variable in accordance with the panel capacitance.

Figure 9:
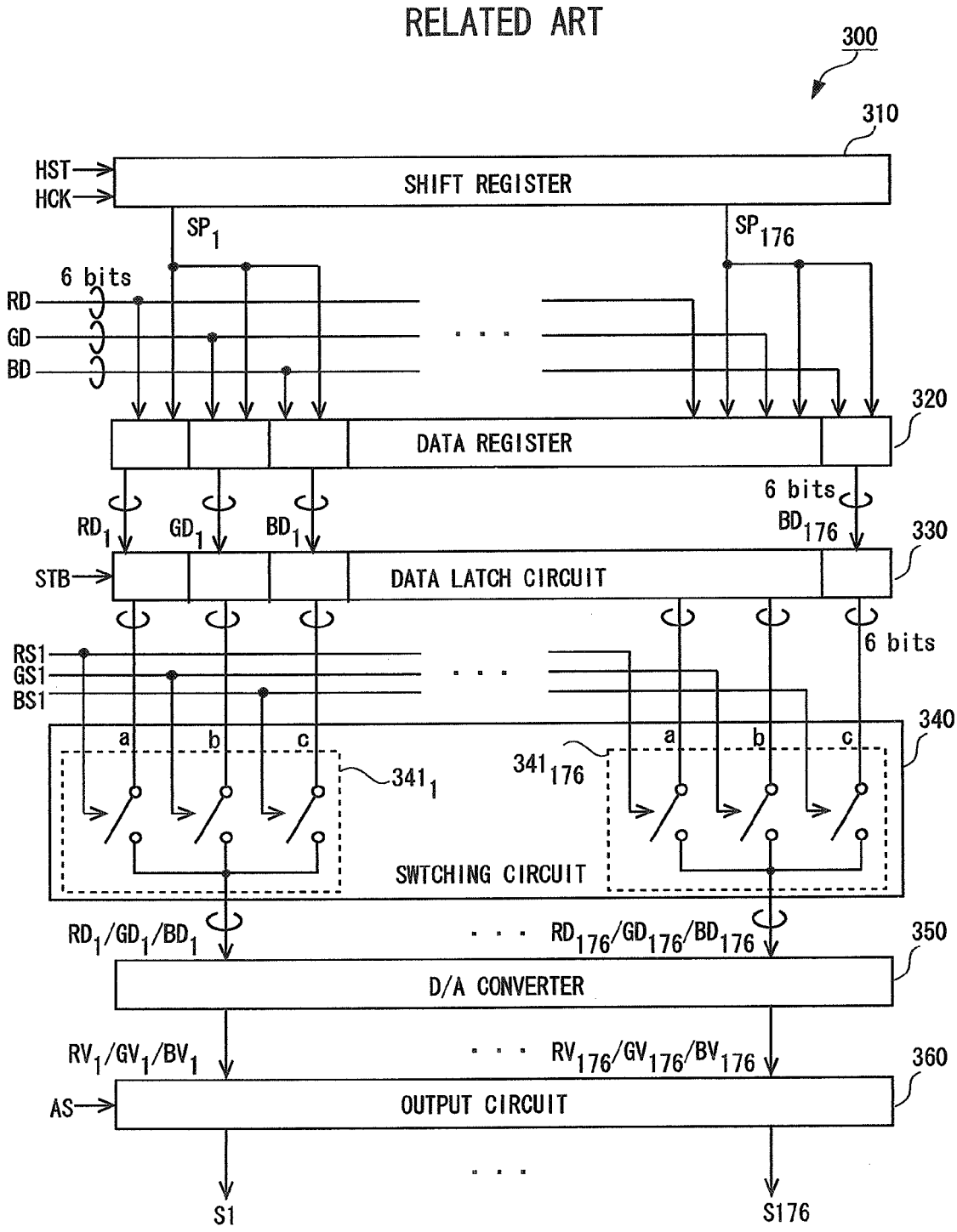
FIG. 9 is a block diagram showing the configuration of a data driver used in the driving circuit for liquid crystal display shown in FIGS. 1 and 7.
Figure 10:
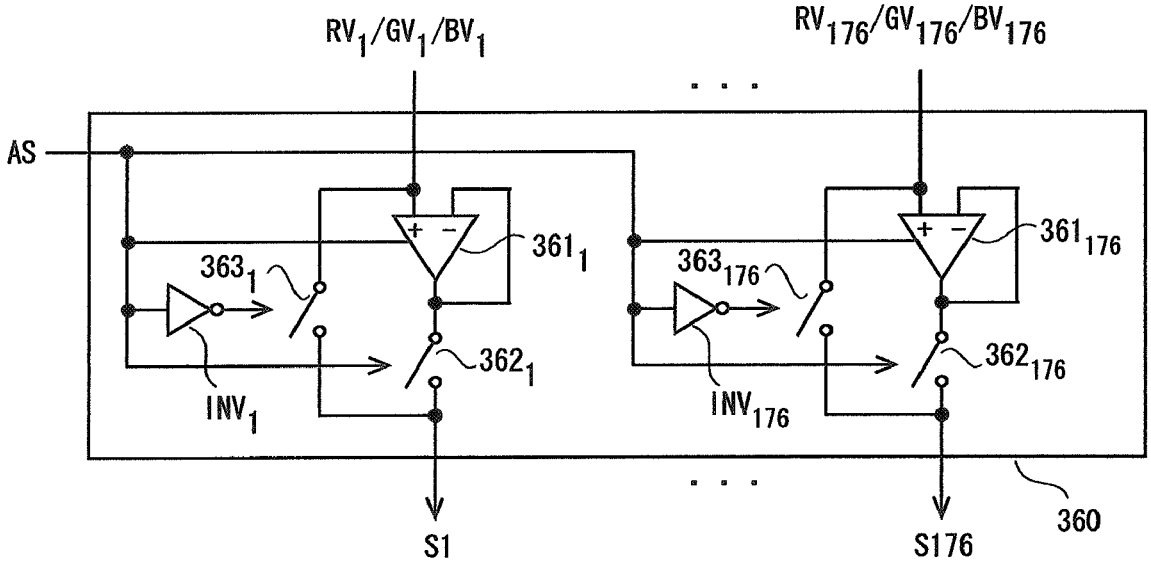
FIG. 10 is a circuit diagram showing the configuration of an output circuit used in the data driver shown in FIG. 9.

The operation of the controller 500 and the data driver 300 in the liquid crystal display driving circuit having the above configuration is described hereinafter. The operation up to the latching of gray scale data by the data latch circuit 330 of the data driver 300 shown in FIG. 9 is the same as the operation in the liquid crystal display driving circuit shown in FIG. 7 and redundant description is not provided herein.

The operation in the data driver 300 shown in FIG. 9 from output of the gray scale data from the data latch circuit 330 to supply of gray scale voltages from the output circuit 360 to each data line is described hereinafter.

(a) When a detection signal is "H" level indicating data mismatch, the gray scale data RD, GD and BD of one scan line 102 is output from the data processor 210 of the controller 500 shown in FIG. 2 and input to the data matching detector 530. Then, the holding signal of "H" level is output from the data matching detector 530 to the control signal generator 520 in synchronization with the rising edge of the dot clock Dclk after the input of the horizontal synchronizing signal Hsync in the next horizontal period. The switch control signals RS1, GS1 and BS1 and the output control signal AS with the timings shown in FIG. 4A (the same timings as in the liquid crystal display driving circuit shown in FIG. 7) is thereby output from the control signal generator 520. The subsequent operation is the same as the operation in the liquid crystal display driving circuit shown in FIG. 7 and thus not described herein.

Figure 5:
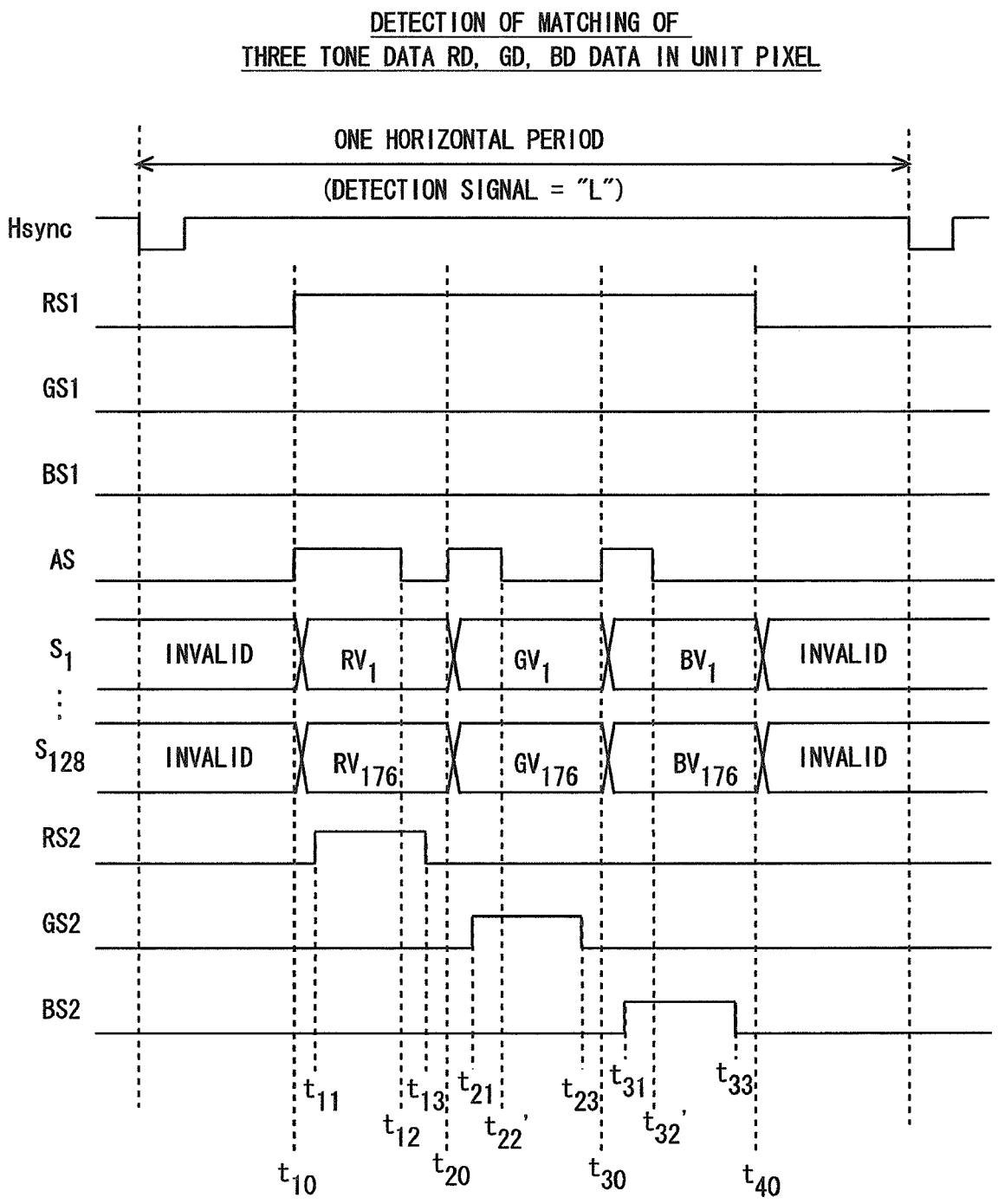
FIG. 5 is a view to describe the operation of the driving circuit for liquid crystal display shown in FIG. 1.

(b) When a detection signal is "L" level indicating data match, the gray scale data RD, GD and BD of one scan line 102 is output from the data processor 210 of the controller 500 shown in FIG. 2 and then input to the data matching detector 530. Then, the detection signal of "L" level is output from the data matching detector 530 to the control signal generator 520 in synchronization with the rising edge of the dot clock Dclk after the input of the horizontal synchronizing signal Hsync in the next horizontal period. The switch control signals RS1, GS1 and BS1 and the output control signal AS with the same timings as those shown in FIG. 4B are thereby output from the control signal generator 520 as shown in the timing chart of FIG. 5. The subsequent operation is the same as the operation in the liquid crystal display driving circuit shown in FIG. 7 and thus only different points are described herein.

During time t20 to t40, the switch control signal RS1 is at "H" level and the switch control signals GS1 and BS1 stay "L" level. In this condition, the input terminal a remains connected to the output terminal in the change-over switches $\mathbf{341}_1$ to $\mathbf{341}_{176}$ of the switching circuit 340 in the data driver 300 shown in FIG. 9. Accordingly, during the period of time t20 to t40, just like the period of time t10 to t20, the time-shared gray scale voltages are output to the output terminals S1 to S176 based on the gray scale data $RD_1$ to $RD_{176}$ latched by the data latch circuit 330 in the data driver 300 shown in FIG. 9.

During time t20 to t40, the output circuit 360 is controlled by the output control signal AS at the pulse periods t20 to t22' and t30 to t32' which are shorter than the pulse period t10 to t12 during time t10 to 20. Therefore, during time t20 to t40, the amplifiers $\mathbf{361}_1$ to $\mathbf{361}_{176}$ of the output circuit 360 enter the non-operating state than the liquid crystal display driving circuit shown in FIG. 7, thereby enabling further reduction in power consumption in the amplifiers.

As described in the foregoing, if the R, G, and B gray scale data match in all unit pixels of one scan line, during the first output interval of the time-sharing output, the amplifiers are turned ON for the operating time period in consideration of a maximum change in gray scale voltage output before and after the shift from the output in the previous horizontal period as in related art. On the other hand, during the second and third output intervals, the amplifiers are turned ON for a short time period within the range to complement the reduction in output voltage due to panel capacitance at the shift of the R, G and B data lines. This enables optimization of a driving time period of the amplifiers and achieves reduction in IC power consumption.

Figure 6:
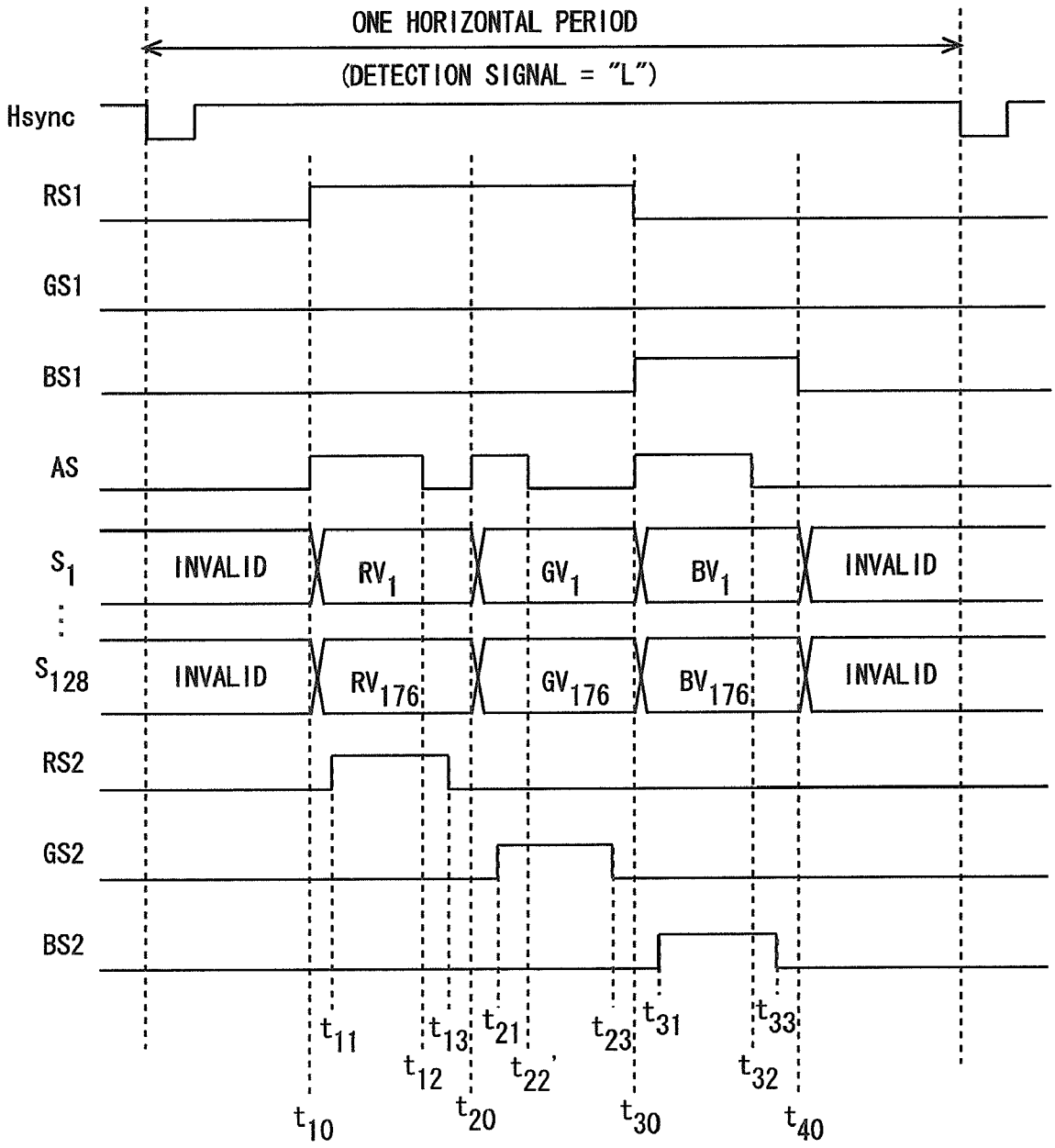
FIG. 6 is a view to describe another example of the operation of the driving circuit for liquid crystal display shown in FIG. 1.

Although the above embodiment describes the case of outputting gray scale voltages in units of one RGB pixel in time-sharing manner from a unit amplifier, gray scale voltages may be output at least in some units of pixels, and the time-sharing output in units of two pixels, which is in units of six data lines, is possible, for example. Further, though the above embodiment describes the case where the three gray scale data RD, GD and BD are the same in one unit pixel, if two data of the two successive outputs are the same, e.g., if two gray scale data RD and GD are the same in one unit pixel, the output control signal AS may be such that the pulse period t20 to t22' is shorter than the pulse period t10 to t12 during time t10 to t20 as shown in FIG. 6.

It is apparent that the present invention is not limited to the above embodiment and it may be modified and changed without departing from the scope and spirit of the invention.

What is claimed is:

1. A driving circuit for liquid crystal display comprising a unit amplifier for time-sharingly outputting a gray scale voltage which is D/A converted from gray scale data corresponding to each sub-pixel at least for each unit pixel to a data line of a liquid crystal panel having a plurality of unit pixels respectively composed of three sub-pixels of red, green and blue for each scan line, the sub-pixels driven through the data line sequentially for each scan line, wherein the gray scale data is compared for each unit pixel, and an operating time of the unit amplifier is controlled based on a comparison result.

2. The driving circuit for liquid crystal display according to claim 1, wherein the time-sharingly output gray scale voltage is output from the unit amplifier for a prescribed time period and then output bypassing the unit amplifier.

3. The driving circuit for liquid crystal display according to claim 2, wherein, if gray scale data corresponding to at least two gray scale voltages which are time-sharingly output in succession match in all unit pixels of each scan line, the prescribed time period is such that a latter output interval is shorter than a first output interval, the outputs corresponding to the matching gray scale data.

4. The driving circuit for liquid crystal display according to claim 3, wherein time-sharing output of a gray scale voltage corresponding to the matching gray scale data is performed using one of the matching gray scale data as representative data.

5. A driving circuit for liquid crystal display, comprising:

a D/A converter for time-sharingly converting gray scale data corresponding to each sub-pixel into a gray scale voltage at least for each unit pixel of a liquid crystal panel having a plurality of unit pixels respectively composed of three sub-pixels of red, green and blue for each scan line, the sub-pixels driven through a data line sequentially for each scan line;

a unit amplifier for time-sharingly inputting and outputting the gray scale voltage, placed at least for each unit pixel; and a data matching detector for comparing the gray scale data for each unit pixel and detecting that gray scale data corresponding to at least two gray scale voltages which are time-sharingly output in succession match in all unit pixels of each scan line;

wherein an operating time of the unit amplifier is controlled based on a detection signal from the data matching detector in each output interval of the time-sharing output.

6. The driving circuit for liquid crystal display according to claim 5, further comprising:

a first switch placed in a subsequent stage of the unit amplifier;

a second switch connected in parallel between an input end of the unit amplifier and an output end of the first switch; and a control signal generator for generating an output control signal for controlling the first and second switches and the unit amplifier based on the detection signal, wherein in each output interval of the time-sharing output, in response to the output control signal, the first switch is turned ON for a prescribed time period, the second switch stays OFF, and the unit amplifier enters an operating state; and after the prescribed time period, the first switch is turned OFF, the second switch is turned ON, and the unit amplifier enters a non-operating state.

7. The driving circuit for liquid crystal display according to claim 6, wherein the prescribed time period is such that a latter output interval is shorter than a first output interval, the outputs corresponding to the matching gray scale data.

8. The driving circuit for liquid crystal display according to claim 7, further comprising:

a switching circuit for supplying the gray scale data time-sharingly to the D/A converter, wherein the control signal generator generates a switch control signal for controlling the switching circuit based on the detection signal, and if the gray scale voltages match, the switching circuit selects one of the matching gray scale data as representative data and time-sharingly outputs a gray scale voltage corresponding to the matching gray scale data.

* * * * *